US011594198B2

(12) United States Patent
Kajita et al.

(10) Patent No.: US 11,594,198 B2
(45) Date of Patent: Feb. 28, 2023

(54) DISPLAY CONTROLLER AND DISPLAY CONTROL METHOD USING BRIGHTNESS DISTRIBUTION OF INPUT IMAGE

(71) Applicant: CANON KABUSHIKI KAISHA, Tokyo (JP)

(72) Inventors: Hajime Kajita, Kanagawa (JP); Hirofumi Urabe, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/238,017

(22) Filed: Apr. 22, 2021

(65) Prior Publication Data

US 2021/0335323 A1 Oct. 28, 2021

(30) Foreign Application Priority Data

Apr. 27, 2020 (JP) ..... JP2020-078472

(51) Int. Cl.
*G09G 5/10* (2006.01)

(52) U.S. Cl.
CPC ..... *G09G 5/10* (2013.01); *G09G 2320/0626* (2013.01); *G09G 2360/147* (2013.01)

(58) Field of Classification Search
CPC ..... G09G 5/10; G09G 2320/0626; G09G 2360/147; G09G 2320/0686; G09G 2360/16
See application file for complete search history.

(56) References Cited

U.S. PATENT DOCUMENTS

2002/0109669 A1* 8/2002 Ha ..... H04N 21/4854 348/E5.1
2004/0042791 A1* 3/2004 Suekane ..... H04N 5/23218 348/E5.035
2004/0125220 A1* 7/2004 Fukuda ..... H04N 5/23216 348/E5.047
2012/0207379 A1* 8/2012 Shimodaira ..... G06V 10/26 382/141
2012/0219218 A1* 8/2012 Demandolx ..... G06T 5/007 382/168
2014/0192233 A1* 7/2014 Kakkori ..... H04N 5/2625 348/239
2016/0042701 A1* 2/2016 Furumoto ..... G02F 1/1347 345/694
2018/0109850 A1* 4/2018 Tsukagoshi ..... H04N 5/278
2019/0189049 A1* 6/2019 An ..... G09G 3/2003

FOREIGN PATENT DOCUMENTS

JP 2009170984 A 7/2009

* cited by examiner

*Primary Examiner* — Rodney Amadiz
(74) *Attorney, Agent, or Firm* — Canon U.S.A., Inc. IP Division

(57) ABSTRACT

A display controller includes a processor and a memory storing a program. The program is executed to cause the processor to function as a detecting unit and a control unit. The detecting unit is configured to detect, based on a brightness distribution of an input image, a region satisfying predetermined conditions from the input image. The control unit is configured to display a display image based on the input image and control a value of representative brightness of the region detected by the detecting unit such that the value is displayed in association with the detected region in the displayed image.

16 Claims, 17 Drawing Sheets

FIG. 3

| COORDINATE | BRIGHTNESS VALUE ($cd/m^2$) |
|---|---|
| (0, 0) | 100 |
| ... | ... |
| (1400, 250) | 800 |
| ... | ... |
| (400, 300) | 900 |
| ... | ... |
| (1600, 400) | 210 |
| ... | ... |
| (1100, 800) | 0.5 |
| ... | ... |
| (1500, 1000) | 0.1 |
| ... | ... |
| (1919, 1079) | 10 |

FIG. 6

| COORDINATE | BRIGHTNESS VALUE ($cd/m^2$) | NOTE |
|---|---|---|
| (400, 300) | 900 | DETECTED IN STEPS S102 AND S107 |
| (1400, 250) | 800 | DETECTED IN STEP S107 |
| (1600, 400) | 210 | DETECTED IN STEP S107 |

FIG. 10

| REGION | BRIGHTNESS CHANGE (UPPER) | BRIGHTNESS CHANGE (LOWER) | BRIGHTNESS CHANGE (LEFT) | BRIGHTNESS CHANGE (RIGHT) | EXCLUSION DETERMINATION | THRESHOLD VALUE |
|---|---|---|---|---|---|---|
| OBJECT 201 | 15 | 15 | 15 | 15 | NOT EXCLUDED | 5 |
| OBJECT 202 | 15 | 15 | 7 | 7 | NOT EXCLUDED | |
| OBJECT 203 | 10 | 10 | 2.2 | 2.2 | EXCLUDED | |

DISPLAY CONTROLLER AND DISPLAY CONTROL METHOD USING BRIGHTNESS DISTRIBUTION OF INPUT IMAGE

BACKGROUND

Technical Field

One disclosed aspect of the embodiments relates to a display controller and a display control method.

Description of the Related Art

In recent years, various standards including Perceptual Quantizer (PQ) and Hybrid Log-Gamma (HLG) have been brought into practical use as the standards of video signals with wider dynamic ranges.

These dynamic ranges are called High Dynamic Range (HDR). In HDR video production, the management of brightness is important, thus the determination of brightness, for example, the confirmation of brightness in a high-brightness region or a low-brightness region of an image, is required. In particular, the determination of the value and position of maximum brightness in a high-brightness region is required in the management of brightness.

A technique for supporting such management of brightness includes pixel value display. The pixel value display is a technique for displaying a brightness value or a Red-Green-Blue (RGB) value at any coordinates in an image. This technique makes it possible to display the brightness value and position of maximum brightness in an image or display a brightness value at any position in an image.

Japanese Patent Application Publication No. 2009-170984 discloses a technique of simultaneously displaying the brightness values of multiple coordinates by using the function of displaying pixel values.

If an image has a plurality of high-brightness regions and a brightness value is displayed relative to a specific position in each of the regions, in the related art, a user inevitably has to specify a position where a brightness value is to be displayed. In confirming brightness in video, a position where brightness is to be confirmed may be shifted according to a change of an image. Thus, it is impractical for a user to manually change a position for displaying a brightness value.

SUMMARY

Hence, the present disclosure provides a technique for facilitating the confirmation of brightness at multiple positions in an image.

The present disclosure includes a display controller including a processor, and a memory storing a program. The program is executed to cause the processor to function as detecting unit and a control unit. The detecting unit is configured to detect, based on a brightness distribution of an input image, a region satisfying predetermined conditions from the input image. The control unit is configured to display a display image based on the input image and control a value of representative brightness of the region detected by the detecting unit such that the value is displayed in association with the detected region in the displayed image.

In addition, the present disclosure includes a display control method including a detecting step and a controlling step. The detecting step detects, based on a brightness distribution of an input image, a region satisfying predetermined conditions from the input image. The controlling step displays a display image based on the input image and controls a value of representative brightness of the region detected in the detecting step such that the value is displayed in association with the detected region in the displayed image.

Further, the present disclosure includes a non-transitory computer-readable storage medium storing a program for causing a computer to function as each unit of the display controller as described above.

Further features of the disclosure will become apparent from the following description of exemplary embodiments with reference to the attached drawings.

BRIEF DESCRIPTION OF THE DRAWINGS

FIG. 3 is a table of brightness distribution information according to the first embodiment.

FIG. 6 is a table of coordinates and brightness values that are outputted to a pixel-value rendering unit according to the first embodiment.

FIG. 10 is a table indicating a change in the brightness of the high-brightness region and the determination of exclusion of the high-brightness region according to the second embodiment.

DESCRIPTION OF THE EMBODIMENTS

Figure 1:
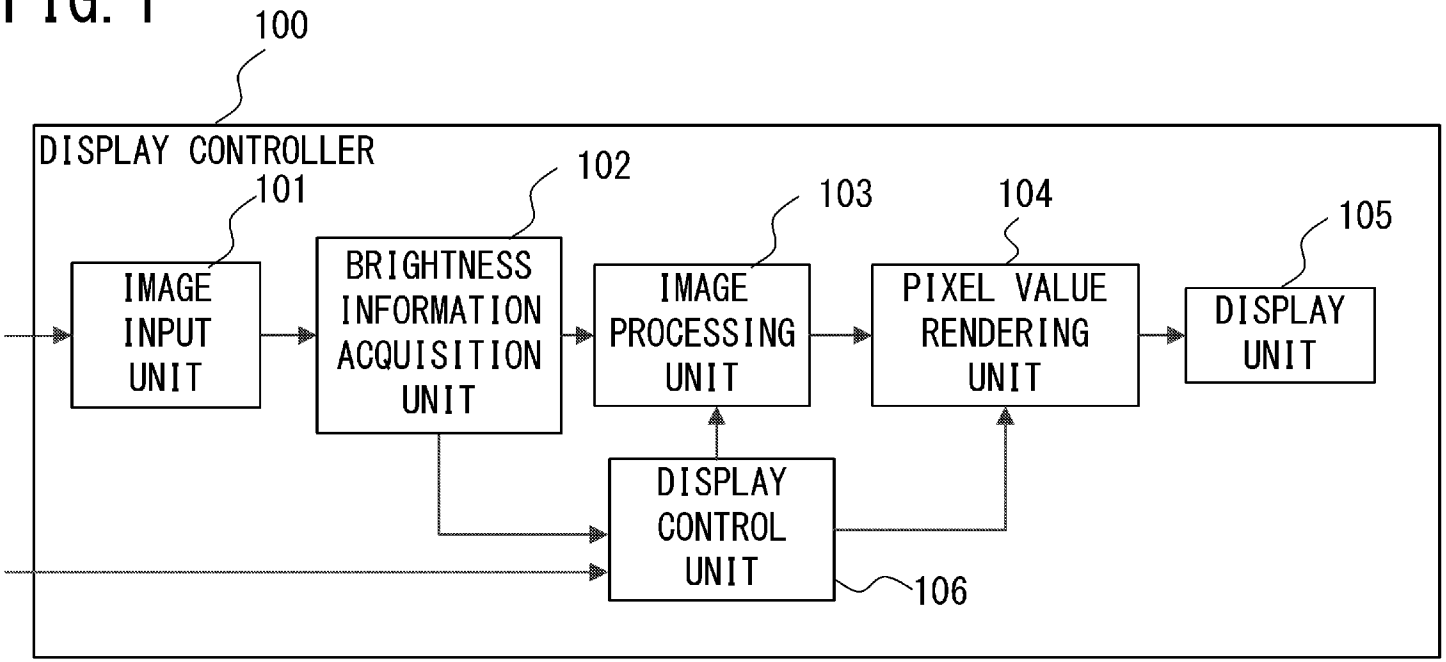
FIG. 1 is a block diagram illustrating the configuration of a display controller according to a first embodiment.

Embodiments of the disclosure will be described below with reference to the accompanying drawings. The same or similar constituent elements, members, and processing in the drawings are indicated by the same reference numerals, and a redundant explanation thereof is optionally omitted. The constituent elements, members, and processing are partially omitted in the drawings.

Figure 17:
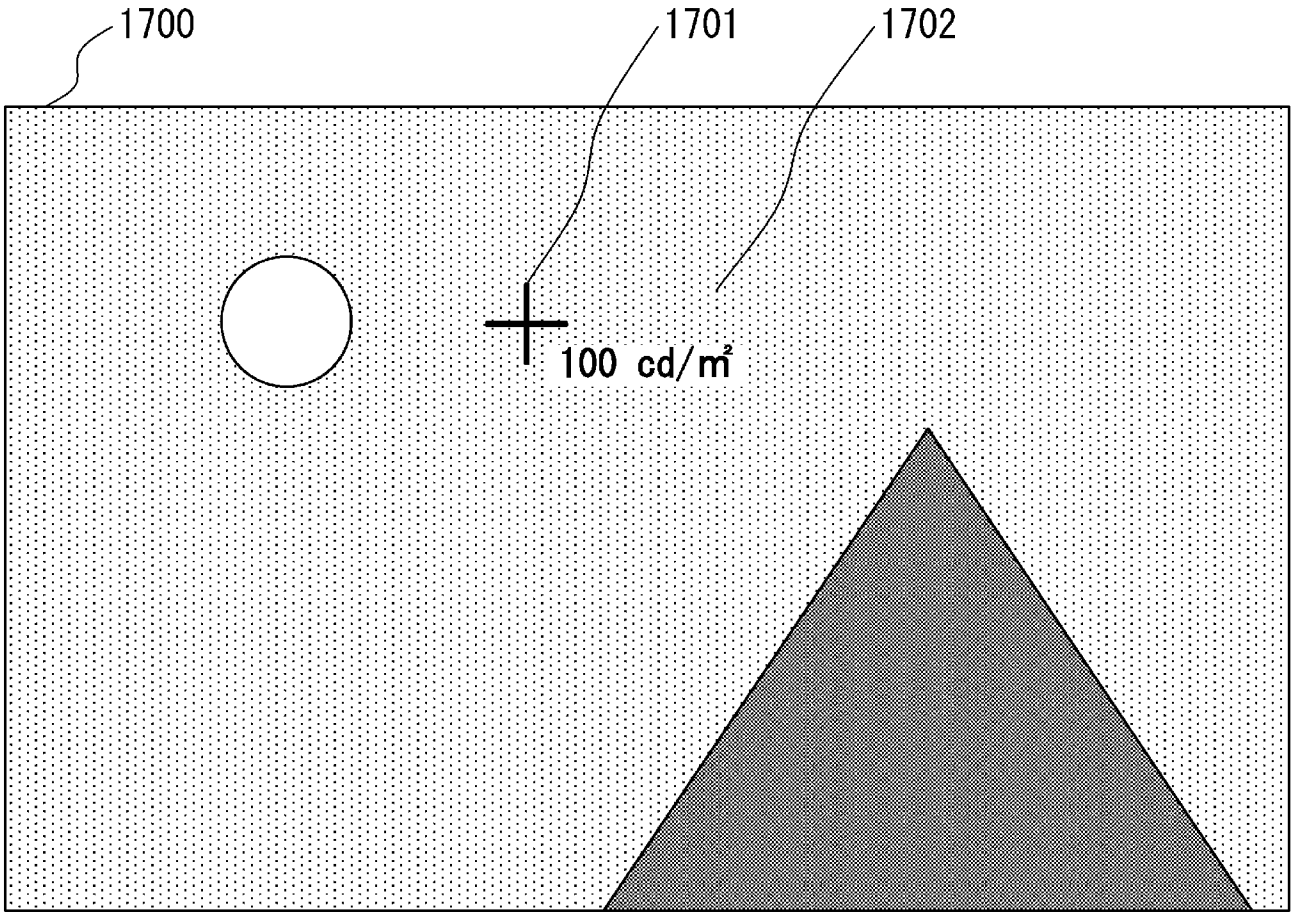
FIG. 17 illustrates a display example of the brightness values of an image according to the related art.

FIG. 17 illustrates the function of displaying a pixel value of an image in a display controller. As illustrated in FIG. 17, the display controller displays an image 1700, a cursor 1701 displayed on the image 1700, and a brightness value 1702.

The cursor 1701 is an indicator that indicates the position of a pixel for displaying a brightness value. The brightness value 1702 is the brightness value of the pixel at the position indicated by the cursor 1701. In the following embodiments, the display controller determines a position for displaying brightness according to the brightness distribution of an image and displays the position and the brightness associated with the position. In the following description, it is assumed that the brightness value of a pixel is displayed. A brightness value is an example of a pixel value to be displayed in an image. The description is also applicable to the display of values such as RGB values indicating other pixel characteristics.

First Embodiment

A display controller according to a first embodiment will be described below. In the present embodiment, the position and brightness value of a pixel indicating maximum brightness in a region larger than a certain size is displayed in a high-brightness region in an image.

FIG. 1 is a block diagram illustrating an example of the configuration of a display controller 100 according to the present embodiment. The display controller 100 includes an image input unit 101, a brightness information acquisition unit 102, an image processing unit 103, a pixel-value rendering unit 104, a display unit 105, and a display control unit 106.

The image input unit 101 receives a video signal, which indicates video contents including a plurality of frames (images), from an external device, e.g., an imaging device or a playback system, and then the image input unit 101 outputs each frame of the received video signal to the brightness information acquisition unit 102. The image of each frame includes a plurality of pixels. For example, a video signal with a resolution of 1920 by 1080 includes 1920×1080=2,073,600 pixels. The image of each frame corresponds to an input image of the disclosure. The image input unit 101 is, for example, an input terminal compliant with standards such as Serial Digital Interface (SDI) and High-Definition Multimedia Interface (HDMI).

Figure 2:
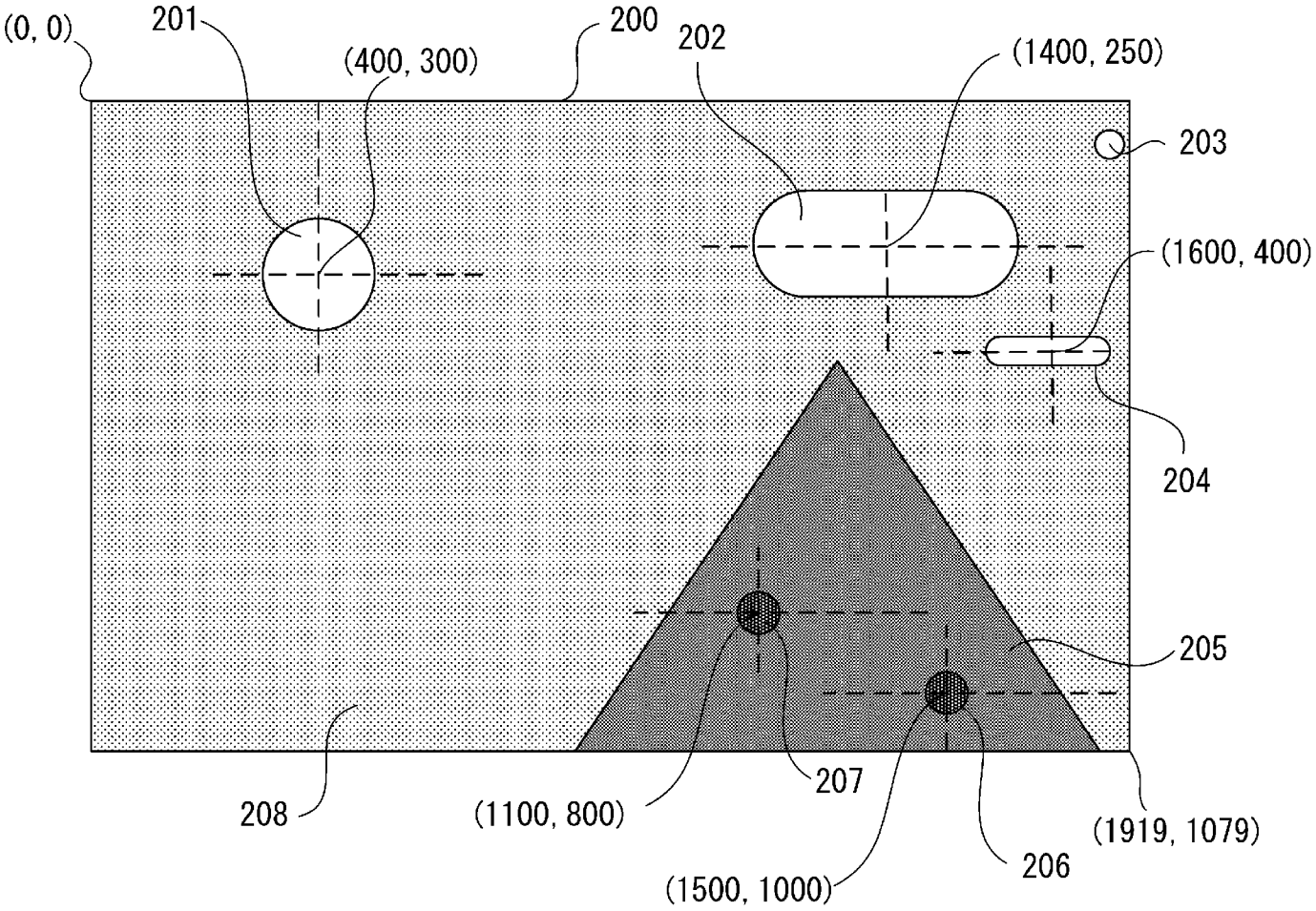
FIG. 2 illustrates an example of an image according to the first embodiment.

FIG. 2 illustrates an example of an image with a resolution of 1920 by 1080. As illustrated in FIG. 2, a position corresponding to a pixel at the upper left corner of the image has coordinates (0,0) while a pixel at the lower right corner of the image has coordinates (1919,1079).

An image 200 in FIG. 2 includes seven objects 201, 202, 203, 204, 205, 206, and 207 and a background 208. In the image 200, pixels constituting the background 208 have the same brightness, and pixels constituting each of the objects 201 to 207 also have the same brightness. For example, the pixels constituting the objects 201 to 207 have brightness values of 900 cd/m$^2$, 800 cd/m$^2$, 700 cd/m$^2$, 210 cd/m$^2$, 10 cd/m$^2$, 0.1 cd/m$^2$, and 0.5 cd/m$^2$, respectively. The objects 201 to 207 are 20000, 50000, 80, 1000, 150000, 120, and 120 in size in the image 200. In this case, an object size in the image means the total number of pixels for a region occupied by the object in the image. However, the size is not limited to the number of pixels. Other indexes including the area of a region occupied by the object may be used as a size, provided that the size of the object in the image is indicated.

The brightness information acquisition unit 102 analyzes an image outputted from the image input unit 101, outputs the analysis result to the display control unit 106, and outputs the image to the image processing unit 103. The brightness information acquisition unit 102 converts the signal values of all the pixels of each inputted image into brightness values, and outputs information on the converted brightness values of the pixels as brightness distribution information to the display control unit 106. In this case, the brightness values are used for the brightness distribution. The brightness distribution may include information other than brightness values, provided that the information indicates brightness.

The signal value of the pixel is converted into a brightness value by using PQ, HLG, or Electro Optical Transfer Function (EOTF) of gamma 2.2 or the like. FIG. 3 indicates an example of a pixel brightness distribution obtained by analyzing the image illustrated in FIG. 2. In this case, the brightness distribution is generated as a brightness distribution for each pixel in the image. For example, a pixel at coordinates (1400,250) has a brightness value of 800 cd/m$^2$ as a brightness distribution. Likewise, a brightness distribution is indicated as a brightness value for each of the pixels at the respective coordinates.

The image processing unit 103 performs image processing on the image outputted from the brightness information acquisition unit 102 and outputs the processed image to the pixel-value rendering unit 104. In the image processing, an image signal is converted into a signal value based on various settings from the display control unit 106 such that the signal value can be displayed on the display unit 105. The various settings include an EOTF setting, a color gamut setting for ITU-R BT.709 or ITU-R BT.2020, and a signal range setting for a limited range or a full range.

The pixel-value rendering unit 104 processes the image outputted from the image processing unit 103, renders the brightness value of a pixel and a cursor serving as an indicator that indicates the position of the pixel, and outputs the processed image as a display image to the display unit 105. At this point, the display control unit 106 determines which one of the pixels is to be indicated with a brightness value based on the brightness distribution of the pixels.

The display unit 105 has a screen including, for example, a backlight and a liquid crystal panel and displays the display image, which is outputted from the pixel-value rendering unit 104, on the screen.

The display control unit 106 is a processing circuit or a programmable device that controls the units of the display controller 100 by executing programs stored in nonvolatile memory (not illustrated). The display control unit 106 receives a user operation through a button (not illustrated) or the like on the display controller 100. The display control unit 106 controls the processing of the image processing unit 103 based on various settings set by user operations, for example, an EOTF setting, a color gamut setting, and a signal range setting. The display control unit 106 corresponds to the detecting unit and control unit of the disclosure. The program is executed to cause the processor to function as the detecting unit and control unit.

Moreover, the set values of the display settings of a pixel value and a high-brightness region by a user operation, the brightness threshold value of a high-brightness region, and the size threshold value of a high-brightness region are stored in memory (not illustrated) in the controller. The display control unit 106 refers to these set values when the following processing is performed. The display setting of a pixel value is a setting indicating whether the function of displaying a pixel value is enabled or not in the display controller 100. The display setting of a high-brightness region is a setting indicating whether the function of determining the number and positions of cursors and pixel values to be displayed is enabled or not, based on the number and positions of high-brightness regions in the image of each frame. The brightness threshold value of a high-brightness region is a threshold value for determining whether the brightness of a pixel is a larger than predetermined brightness or not. The predetermined brightness is an example of first predetermined brightness. The size threshold value of a high-brightness region is a threshold value for determining whether the size of a high-brightness region is larger than a predetermined size or not. These threshold values are examples of predetermined conditions. The display control unit 106 detects a region satisfying the predetermined conditions from an input image.

Referring to the display setting of a pixel value, if the function is enabled, the display control unit 106 calculates the coordinates and the brightness value of a pixel with a pixel value to be displayed, based on the brightness distribution information outputted from the brightness information acquisition unit 102. The display control unit 106 then outputs the calculated coordinates and brightness value of the pixel to the pixel-value rendering unit 104.

Referring to the flowchart of FIG. 4, the generation of display coordinates in the display control unit 106 will be described below. When receiving the brightness distribution information on frames from the brightness information acquisition unit 102, the display control unit 106 starts the processing of the flowchart of FIG. 4.

In step S101, the display control unit 106 refers to the display setting of a pixel value. If the display setting of a pixel value is enabled (S101: Yes), the display control unit 106 advances to step S102. If the setting is disabled (S101: No), the display control unit 106 terminates the processing of the flowchart.

In step S102, the display control unit 106 then acquires a maximum brightness value in an image and the coordinates of a pixel having the maximum brightness value. Specifically, the display control unit 106 searches the brightness distribution inputted from the brightness information acquisition unit 102, calculates the brightness value of highest brightness as a maximum brightness value, and calculates the coordinates of a pixel having the maximum brightness value. In the presence of multiple pixels having the maximum brightness value in the image, any one of the pixels may be determined as a pixel having the maximum brightness value. From among pixels having the maximum brightness value, one of the pixels may be designated at a position that can be specified by a predetermined direction. For example, the pixel having coordinates at the top left of the image may be designated as a pixel having the maximum brightness value. Alternatively, from among pixels having the maximum brightness value, a pixel closest to the barycenter may be designated as a pixel having the maximum brightness value. In the example of the brightness distribution in FIG. 3, coordinates (400,300) are designated as a pixel having a maximum brightness value, and a brightness value of 900 cd/m$^2$ is calculated. The maximum brightness value is an example of a representative brightness value of the disclosure.

In step S103, the display control unit 106 refers to the display setting of a high-brightness region. If the setting is enabled (S103: Yes), the display control unit 106 advances to step S104. If the setting is disabled (S103: No), the display control unit 106 advances to step S108.

In step S104, the display control unit 106 detects a high-brightness region in the image based on the brightness distribution information inputted from the brightness information acquisition unit 102. Specifically, the display control unit 106 searches the brightness distribution, classifies, as high-brightness pixels, pixels having brightness values larger than the threshold value indicated by the setting of the brightness threshold value of a high-brightness region, and classifies pixels having brightness values smaller than the threshold value as low-brightness pixels. The display control unit 106 then determines the presence or absence of adjacent high-brightness pixels from high-brightness pixels at the upper left corner of the image. In the presence of adjacent high-brightness pixels, the pixels are categorized as the same high-brightness region.

Figure 5A:
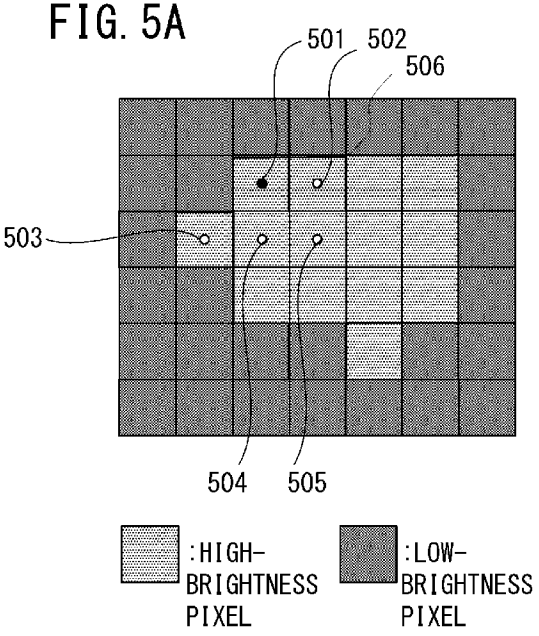
FIGS. 5A to 5C illustrate a method of detecting a high-brightness region according to the first embodiment.
Figure 5B:
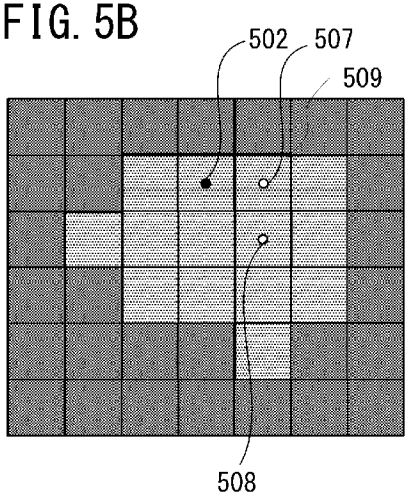
Figure 5C:
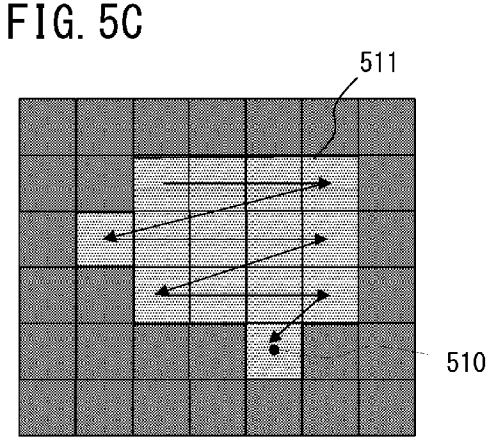

Referring to FIGS. 5A to 5C, the classification of high-brightness regions by the display control unit 106 will be further described below. A pixel serving as a criterion for determining the presence or absence of adjacent high-brightness pixels will be referred to as a reference pixel.

First, a high-brightness pixel 501 at the top left of an image is designated as the reference pixel from among high-brightness pixels. Eight pixels are adjacent to the pixel 501 serving as the reference pixel. In the example of FIG. 5A, four pixels 502 to 505 of the eight pixels are high-brightness pixels. The four adjacent pixels 502 to 505, which are high-brightness pixels, are classified as a high-brightness region 506, the same high-brightness region as the reference pixel. Subsequently, as illustrated in FIG. 5B, the pixel 502 on the right of the pixel 501 serving as the reference pixel is designated as a new reference pixel, and then high-brightness pixels are similarly searched. In the example of FIG. 5B, two high-brightness pixels 507 and 508, which are not classified as high-brightness pixels in the previous search, are specified from among the adjacent pixels. The additionally specified high-brightness pixels 507 and 508 are classified as the same high-brightness region as the reference pixel. This extends the high-brightness region 506 to a high-brightness region 509. In this way, the reference pixel is changed (from the pixel 501 in FIG. 5A to a pixel 510 in FIG. 5C); meanwhile, the high-brightness region is determined based on additionally specified high-brightness pixels. This process is repeated to specify adjacent high-brightness pixels from pixels in the high-brightness region. Hence, as illustrated in FIG. 5C, the adjacent high-brightness pixels are classified as a high-brightness region 511.

For example, if the brightness threshold value of a high-brightness region is set at 203 cd/m$^2$, the object 201, the object 202, the object 203, and the object 204 in the image 200 of FIG. 2 are high-brightness regions detected by the display control unit 106. The object 201 has a brightness value of 900 cd/m$^2$, the object 202 has a brightness value of 800 cd/m$^2$, the object 203 has a brightness value of 700 cd/m$^2$, and the object 204 has a brightness value of 210 cd/m$^2$. The adjacent pixels are specified by eight pixels in the vertical, horizontal, and diagonal directions or four pixels only in the vertical and horizontal directions. The adjacent pixels may be specified by any other techniques.

Subsequently, in step S105, the display control unit 106 refers to the size threshold value of a high-brightness region. From among the high-brightness regions detected in step S104, the display control unit 106 designates the region larger than the size threshold value (the number of pixels is larger than a predetermined number) as a high-brightness region. Furthermore, the display control unit 106 excludes the region smaller than the size threshold value from the high-brightness region. For example, if the size threshold value of the high-brightness region is set at 100, the size of the object 203 is 80 in the image of FIG. 2 and thus the region of the object 203 is excluded from the high-brightness region.

A small-sized high-brightness region is assumed to be less important than a large-sized high-brightness region in confirming the brightness of the region. Thus, the present embodiment excludes a high-brightness region smaller than the size threshold value from the display of brightness values, thereby preventing the number of displayed brightness values from excessively increasing in the image.

Subsequently, in step S106, the display control unit 106 determines whether at least one high-brightness region is detected or not. If at least one high-brightness region is detected (S106: Yes), the display control unit 106 advances to step S107. If no high-brightness region is detected (S106: No), the display control unit 106 advances to step S108. In the image 200 of FIG. 2, the regions of the objects 201, 202, and 204 are detected as high-brightness regions, so that the number of detected high-brightness regions is three. Thus, the display control unit 106 advances from step S106 to step S107.

In step S107, the display control unit 106 calculates a maximum brightness value and the coordinates of a pixel having the maximum brightness value in each high-brightness region in the image. Specifically, for each high-brightness region, the display control unit 106 searches the brightness distribution inputted from the brightness information acquisition unit 102, calculates the brightness value of highest brightness in the region as a maximum brightness value, and calculates the coordinates of a pixel having the maximum brightness value. In the presence of multiple pixels having the maximum brightness value in the image, any one of the pixels may be determined as a pixel having the maximum brightness value. From among pixels having the maximum brightness value in the high-brightness region, one of the pixels may be designated at a position that can be specified by a predetermined direction. For example, the pixel having coordinates at the top left of the image may be designated as a pixel having the maximum brightness value. Alternatively, from among pixels having the maximum brightness value in the high-brightness region, a pixel closest to the barycenter may be designated as a pixel having the maximum brightness value. From among pixels having the maximum brightness value in the high-brightness region, a pixel close to the center (barycenter) in the high-brightness region may be designated as a pixel having the maximum brightness value.

In the example of the brightness distribution in FIG. 3, the high-brightness region of the object 201 has a maximum brightness value of 900 cd/m$^2$ and coordinates (400,300), which are calculated by the display control unit 106. Likewise, the high-brightness region of the object 202 has a maximum brightness value of 800 cd/m$^2$ and coordinates (1400,250), and the high-brightness region of the object 204 has a maximum brightness value of 210 cd/m$^2$ and coordinates (1600,400).

Subsequently, in step S108, the display control unit 106 outputs the maximum brightness value and the coordinates of the pixel in the image according to the calculation in step S102 and the maximum brightness value and the coordinates of the pixel in each of the high-brightness regions according to the calculation in step S107, the maximum brightness values and coordinates being outputted to the pixel-value rendering unit 104. FIG. 6 is a table indicating a list of the coordinates and brightness values of pixels, the coordinates and brightness values being outputted to the pixel-value rendering unit 104. As indicated in the table of FIG. 6, information on a brightness value of 900 cd/m$^2$ at coordinates (400,300), a brightness value of 800 cd/m$^2$ at coordinates (1400,250), and a brightness value of 210 cd/m$^2$ at coordinates (1600,400) is outputted to the pixel-value rendering unit 104. As indicated in FIG. 6, the coordinates (400,300) and the brightness value of 900 cd/m$^2$ are repeatedly calculated in step S102 and step S107. In the case of the repeated calculation of the coordinates and the brightness value in combination, the information on the coordinates and the brightness value to be outputted to the pixel-value rendering unit 104 may be calculated in any one of the steps. The pixel-value rendering unit 104 renders the brightness values of pixels and cursors serving as indicators for indicating the positions of the pixels in the image, based on the information on the coordinates and the brightness values that are inputted from the display control unit 106, and outputs an image signal as a processed display image to the display unit 105. The display unit 105 displays the display image based on the image signal inputted from the pixel-value rendering unit 104.

Figure 7:
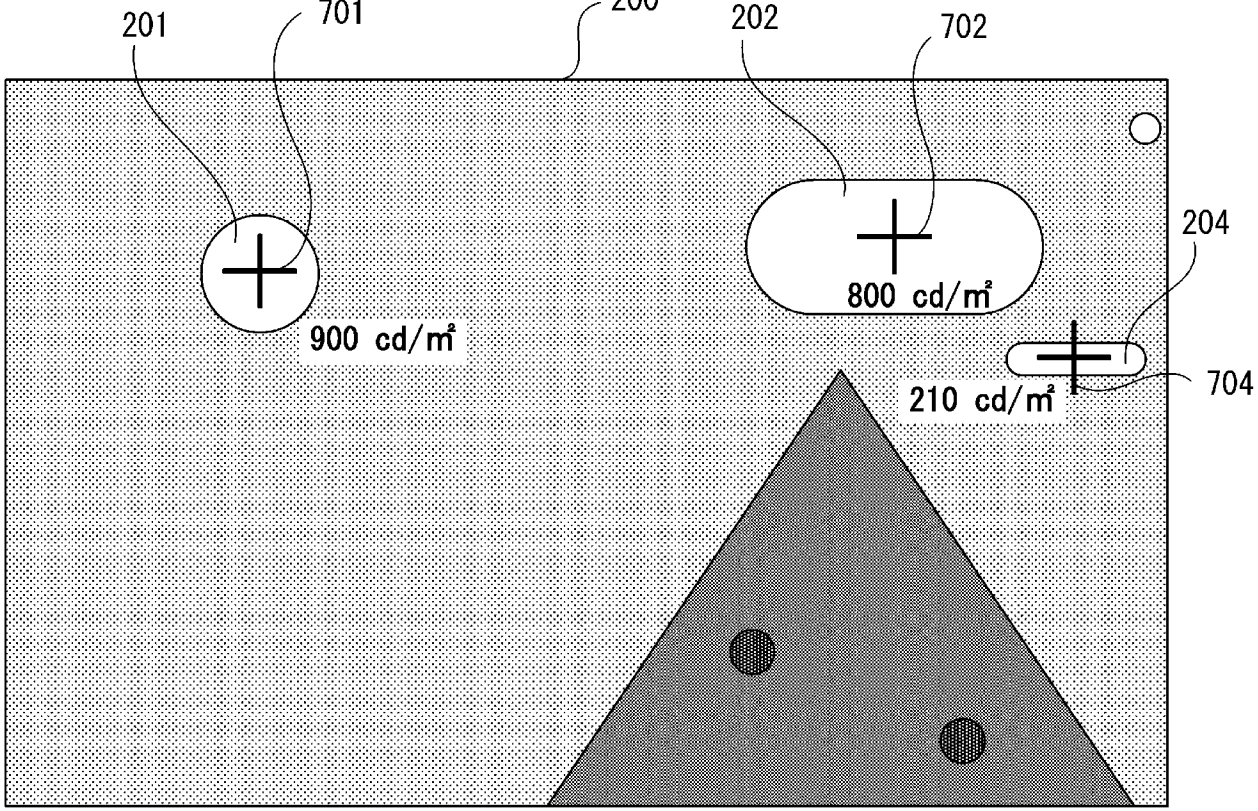
FIG. 7 illustrates a display example of brightness values according to the first embodiment.

FIG. 7 illustrates a display example of the image 200 displayed by the display unit 105 and cursors and brightness values that are superimposed on the image. As illustrated in FIG. 7, a cursor 701 indicating the position of a pixel having a maximum brightness value and the brightness value ("900 cd/m$^2$" in FIG. 7) are displayed for the region of the object 201 in the image 200. Likewise, a cursor 702 indicating the position of a pixel having a maximum brightness value and the brightness value ("800 cd/m$^2$" in FIG. 7) are displayed for the region of the object 202. A cursor 704 indicating the position of a pixel having a maximum brightness value and the pixel value ("210 cd/m$^2$" in FIG. 7) are displayed for the region of the object 204.

As described above, the present embodiment can detect a pixel having maximum brightness in a high-brightness region larger than a certain size in an image based on the brightness distribution of the image, and display a brightness value associated with each detected pixel. Thus, a representative brightness value in the high-brightness region is displayed in relation to the pixel in the region. This can determine a change of the position and the maximum brightness of an object having a large high-brightness region in the image and save time for manually changing the number of displayed brightness values and the display positions.

Second Embodiment

A display controller according to a second embodiment will be described below. The present embodiment displays the brightness value of a pixel having maximum brightness in a region that is larger than a certain size in a high-brightness region in an image and changes in brightness from a low-brightness region around the high-brightness region to a degree higher than a certain degree. In the following description, the same configurations as those of the first embodiment are indicated by the same reference numerals, and a detailed explanation thereof is omitted.

In addition to the foregoing settings, a display control unit 106 in a display controller 100 according to the present embodiment has a set value for the brightness change threshold value of the high-brightness region. In this case, the brightness change threshold value of the high-brightness region is a threshold value for determining whether a change in brightness between the high-brightness region and the low-brightness region around the high-brightness region is greater than a certain degree or not.

Figure 4:
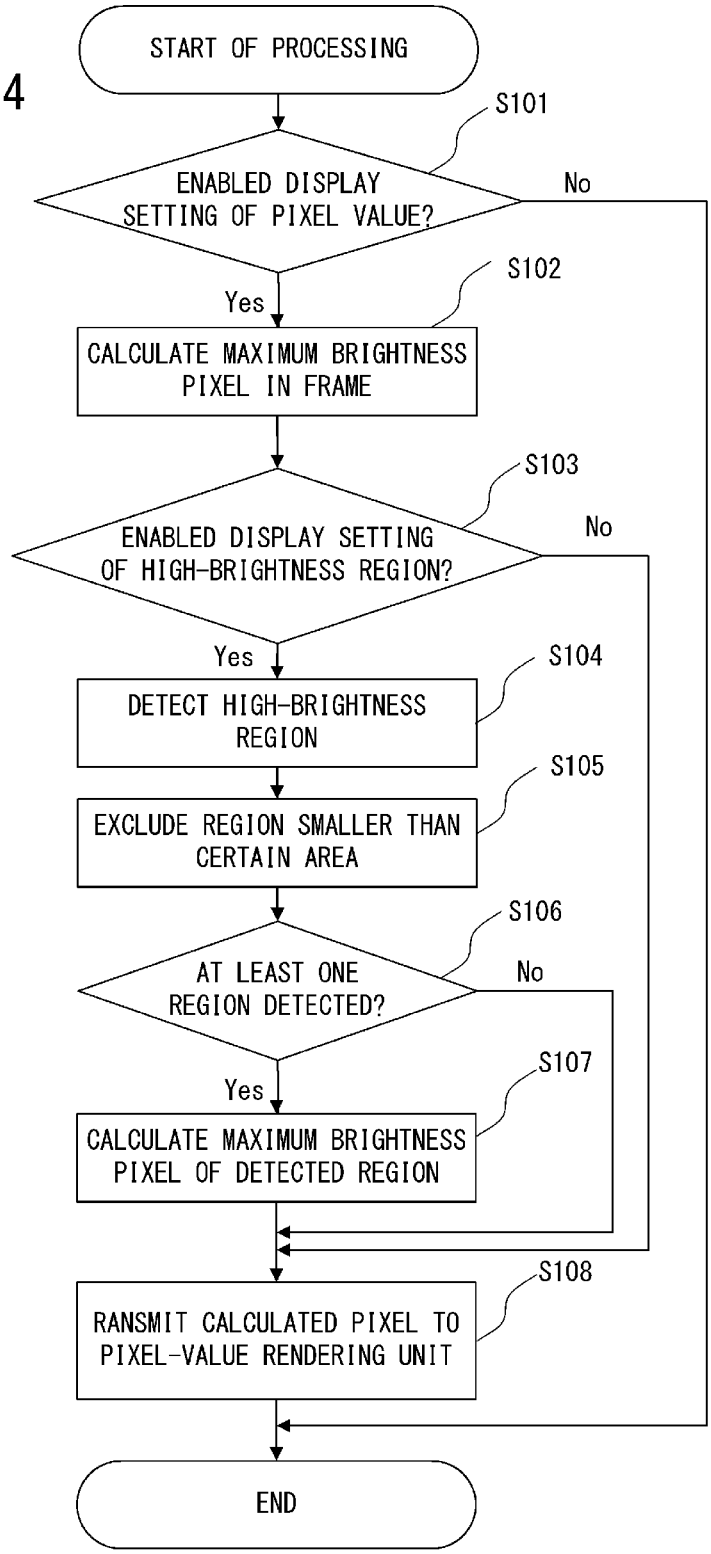
FIG. 4 is a flowchart of processing performed by the display controller according to the first embodiment.
Figure 8:
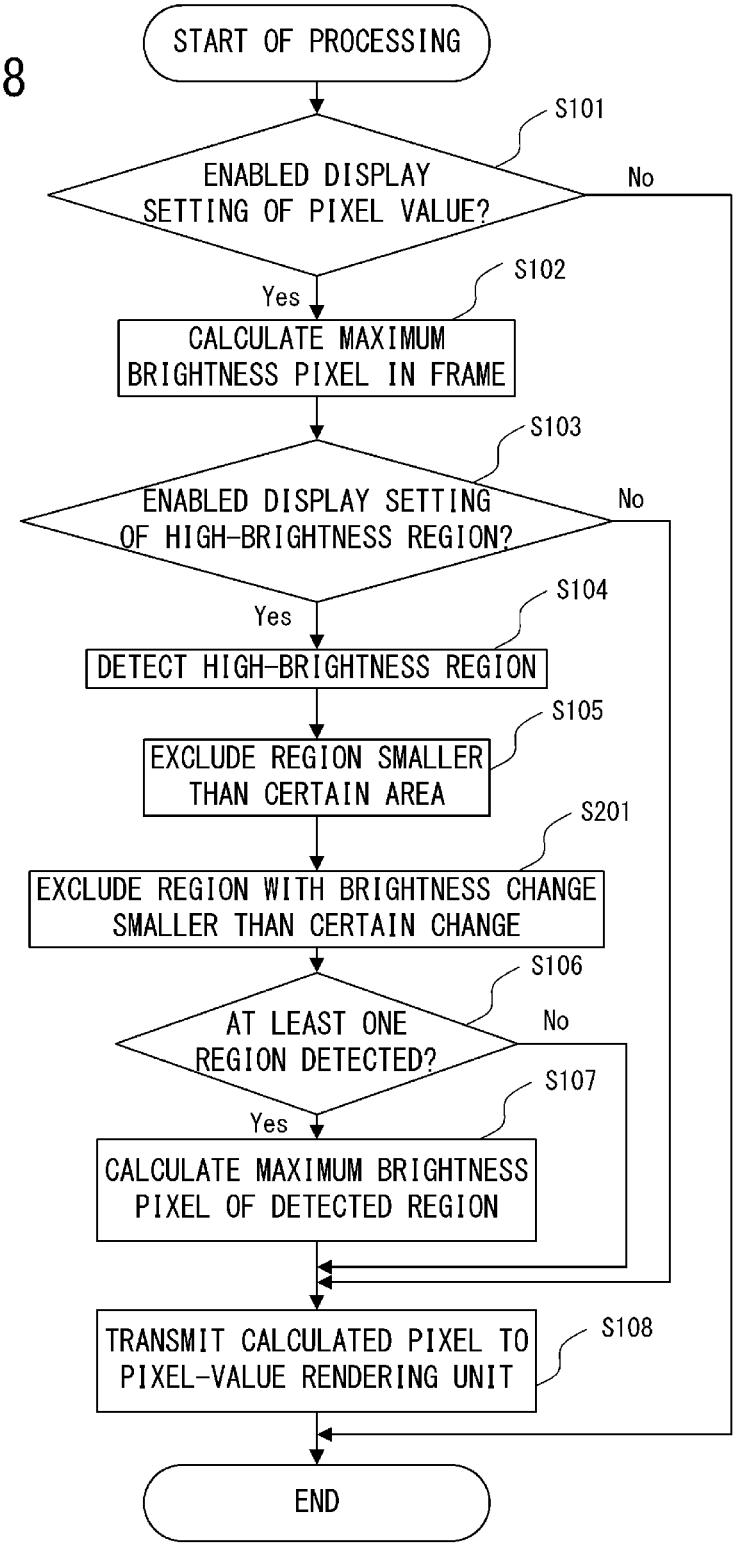
FIG. 8 is a flowchart of processing performed by a display controller according to a second embodiment.

In the present embodiment, the coordinates of a pixel having a maximum brightness value in the high-brightness region are generated by the display control unit 106 according to the flowchart of FIG. 8 instead of the flowchart of FIG. 4. When receiving brightness distribution information on frames from a brightness information acquisition unit 102, the display control unit 106 starts the processing of the flowchart of FIG. 8.

The processing performed by the display control unit 106 according to the flowchart of FIG. 8 is different from that of the flowchart of FIG. 4 in the addition of the processing of step S201 between step S105 and step S106. Processing from step S101 to step S105 and processing from step S106 to step S108 are similar to that of the first embodiment.

In step S201, the display control unit 106 refers to the brightness change threshold value of the high-brightness region and determines whether a change in brightness in the high-brightness region, which is not excluded in step S105, from the low-brightness region around the high-brightness region is larger than the brightness change threshold value of the high-brightness region. The display control unit 106 then excludes, from the high-brightness region, a high-brightness region in which a change in brightness from the surrounding low-brightness region is smaller than the brightness change threshold value of the high-brightness region.

Figure 9:
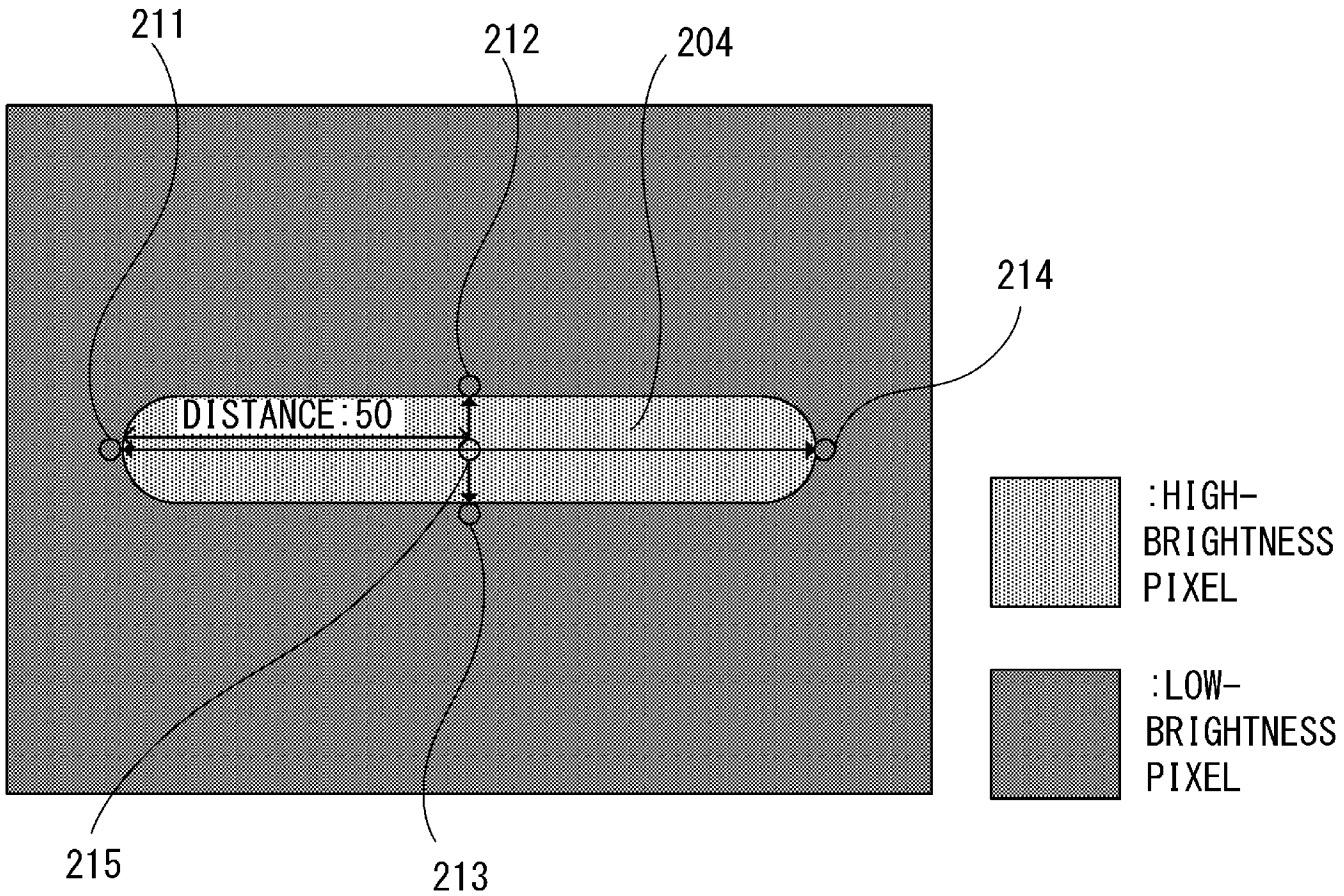
FIG. 9 illustrates a method of calculating a change in brightness of a high-brightness region according to the second embodiment.

A method of calculating a change in brightness between the high-brightness region and the surrounding low-brightness region will be specifically described below. FIG. 9 is an explanatory drawing illustrating a calculation example of a change in brightness between the region of an object 204 and a surrounding low-brightness region in an image 200. The display control unit 106 first calculates a maximum brightness value and the coordinates of a pixel having the maximum brightness value in each high-brightness region according to the same method as step S107. In the presence of multiple pixels having the maximum brightness value in the region, a pixel close to the barycenter of the pixels or the center (barycenter) of the region is designated as a pixel having the maximum brightness value. The display control unit 106 then extends straight lines in the vertical and horizontal directions from the coordinates indicating the maximum brightness value and specifies positions where the straight lines cross the low-brightness region with the shortest distances. Subsequently, the display control unit 106 calculates the coordinates and the brightness values of pixels at the positions specified in the respective directions. In the example of FIG. 9, pixels 211 to 214 are located at the positions specified by the display control unit 106. A pixel 215 has the maximum brightness value in the high-brightness region.

In the present embodiment, a change in brightness is calculated by dividing a difference between the maximum brightness value of the high-brightness region and the brightness of the pixel corresponding to the specified position in the low-brightness region by a distance between the pixel having the maximum brightness value and the pixel at the specified position. In this case, the distance between the pixels is the number of pixels between the two pixels. The distance between the pixels is not limited to the number of pixels. Other indexes such as a length between pixels may be used instead.

For example, in the case of the object 204, the pixel 215 has a brightness value (maximum brightness value) of 210 cd/m$^2$, whereas the pixel 211 has a brightness value (the brightness value of the low-brightness region) of 100 cd/m$^2$. A distance between the pixel 211 and the pixel 215 is 50. Thus, a change in brightness between the pixel 211 and the pixel 215 is calculated as indicated by expression (1) below. The calculation of a change in brightness is not limited, provided that a difference in brightness between the high-brightness region and the low-brightness region can be calculated.

$$(210-100)/50=2.2 \quad (1)$$

In step S201, the display control unit 106 calculates a change in brightness in each of the vertical and horizontal directions in the high-brightness region and excludes the high-brightness region from the display of brightness values if the calculated changes are all smaller than the brightness change threshold value of the high-brightness region.

In this case, a change in brightness between the high-brightness region and the low-brightness region is calculated from a maximum-brightness pixel included in the high-brightness region and a low-brightness pixel including in the surrounding low-brightness region. However, a pixel having a maximum brightness value in the high-brightness region may be replaced with a pixel having another brightness value in the high-brightness region. For example, if a change in brightness is calculated by using the pixel value of the pixel 211 in the example of FIG. 9, a change in brightness may be similarly calculated by using the brightness value of a pixel closer to the pixel 211 than the pixel 215 from among pixels in the high-brightness region.

FIG. 10 indicates changes in brightness in the vertical and horizontal directions in the high-brightness regions of the objects 201, 202, and 204 after step S105 is performed on the image 200 of FIG. 2 and indicates whether to exclude the high-brightness regions according to determination in step S201. In this case, the brightness change threshold value of the high-brightness region is assumed to be set at 5. As indicated in FIG. 10, changes in brightness of the object 201 and the object 202 in the vertical and horizontal directions are larger than the brightness change threshold value of the high-brightness region. Thus, the high-brightness regions of the object 201 and the object 202 are not excluded by the determination in step S201. However, a change in brightness of the object 204 in the horizontal direction is smaller than the brightness change threshold value of the high-brightness region. Thus, the object 204 is excluded from the high-brightness region by the determination in step S201.

In the above-mentioned processing, the object is excluded from the high-brightness region if a change in brightness from the surrounding low-brightness region is smaller than the threshold value in any one of the vertical and horizontal directions of the high-brightness region. The exclusion from the high-brightness region may be avoided if a change in brightness from the surrounding low-brightness region is larger than the threshold value at least in one of the vertical and horizontal directions of the high-brightness region. Alternatively, the determination in step S201 may be made based on a change in brightness from the surrounding low-brightness region in other directions of the high-brightness region in addition to or instead of the vertical and horizontal direction of the high-brightness region. Furthermore, a change in the brightness of the high-brightness region is calculated based on a brightness value at each position on the edge of the high-brightness region. A change in the brightness of the high-brightness region may be calculated based on a representative value (e.g., a mean value, an intermediate value, a mode, or a maximum value) of a brightness difference among multiple positions.

Figure 11:
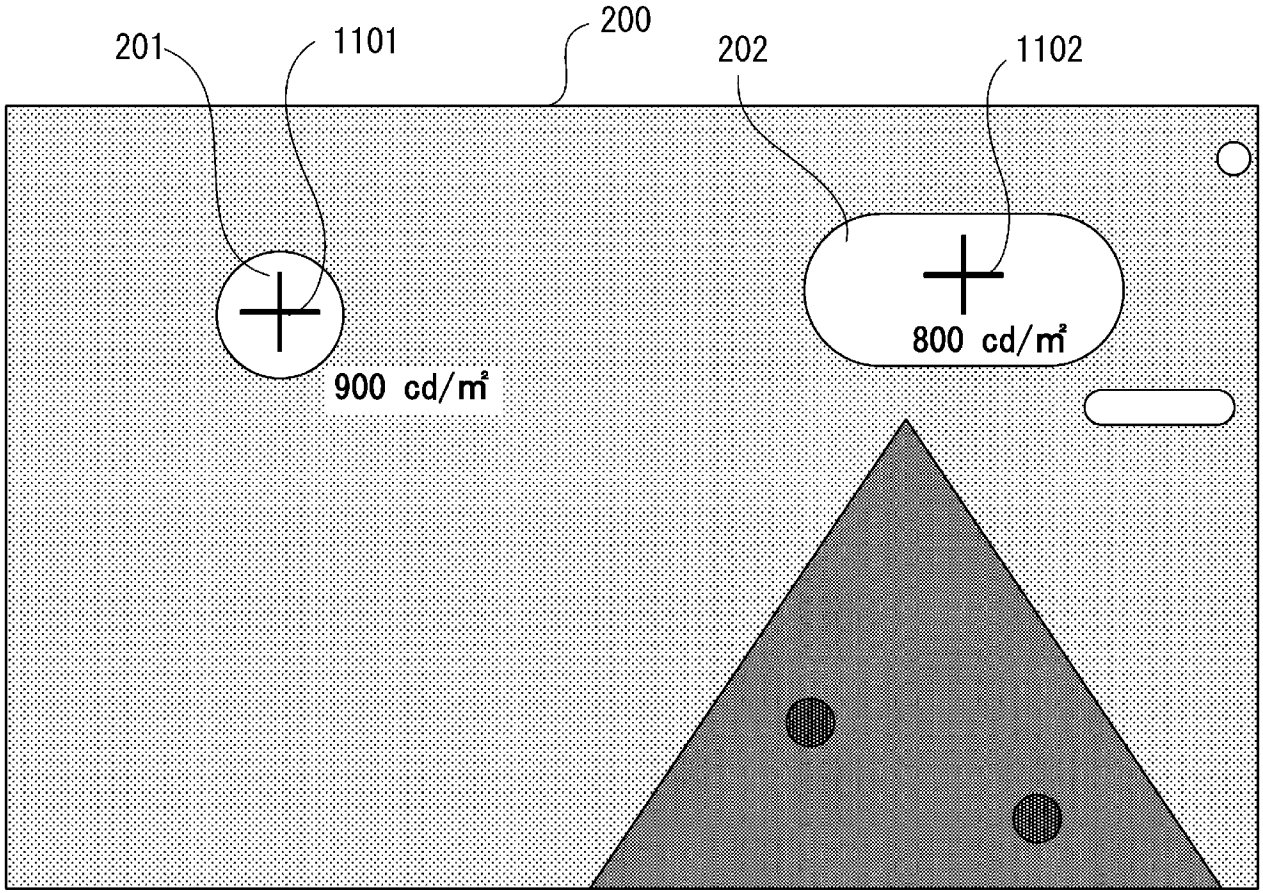
FIG. 11 illustrates a display example of brightness values according to the second embodiment.

The image 200 is displayed on a display unit 105 by the above-mentioned processing. Furthermore, a cursor indicating the position of a pixel having a maximum brightness value and the brightness value of the pixel are displayed for the high-brightness region that is larger than a certain size and changes in brightness to a degree higher than a certain degree. FIG. 11 illustrates a display example of an image 200 provided by the display unit 105. As illustrated in FIG.

11, cursors 1101 and 1102 and pixel values are displayed on two objects 201 and 202 in an image 200.

As described above, in the present embodiment, a pixel having a maximum brightness value is detected in a high-brightness region that is larger than a certain size and changes in brightness to a degree higher than a certain degree in an image, and a brightness value is displayed for each detected pixel based on the brightness distribution of the image. Thus, if a change in brightness from a surrounding region is small in a high-brightness region, the high-brightness region is regarded as being less significant in terms of a change in brightness and is excluded from the display of brightness values. This raises expectations on the effect of preventing the number of displayed brightness values from excessively increasing in the image and reducing the viewability of the image.

Third Embodiment

A display controller according to a third embodiment will be described below. In the present embodiment, in addition to the display of brightness values in a high-brightness region in an image, a brightness value is displayed in a low-brightness region including a pixel having a minimum brightness value in the image from among low-brightness regions larger than a certain size. In the following description, the same configurations as those of the first and second embodiments are indicated by the same reference numerals, and a detailed explanation thereof is omitted.

In addition to the foregoing settings, a display control unit 106 in a display controller 100 according to the present embodiment has set values for the display setting of a low-brightness region, the brightness threshold value of a low-brightness region, and the size threshold value of a low-brightness region. The display setting of a low-brightness region is a setting indicating whether the function of determining the number and positions of cursors and pixel values to be displayed is enabled or not, based on the number and positions of high-brightness regions in the image of each frame. The brightness threshold value of a low-brightness region is a threshold value for determining whether the brightness of a pixel is not more than predetermined brightness or not. The predetermined brightness is an example of second predetermined brightness. The size threshold value of a low-brightness region is a threshold value for determining whether the size of a low-brightness region is larger than a certain size or not.

Figure 12:
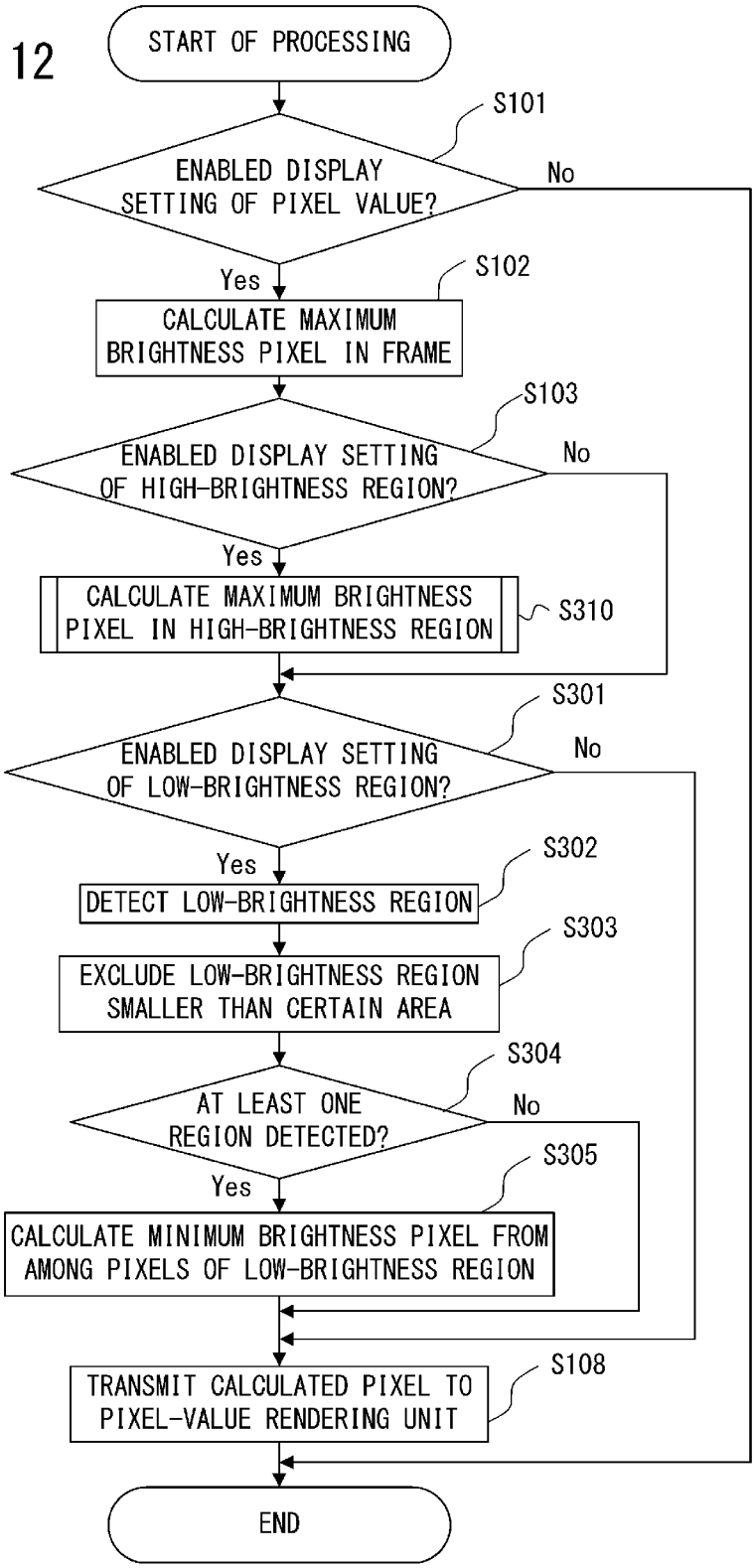
FIG. 12 is a flowchart of processing performed by a display controller according to a third embodiment.

In the present embodiment, the coordinates of a pixel having a minimum brightness value in an image are generated by the display control unit 106 according to the flowchart of FIG. 12 instead of the flowchart of FIG. 8 of the second embodiment. When receiving brightness distribution information on frames from a brightness information acquisition unit 102, the display control unit 106 starts the processing of the flowchart of FIG. 12.

The processing performed by the display control unit 106 according to the flowchart of FIG. 12 is different from that of the flowchart of FIG. 8 in the addition of the processing of step S301 to step S305 between step S107 and step S108. Processing from step S301 to step S305 is similar to that of the second embodiment. In the flowchart of FIG. 12, the processing of steps S104, S105, S201, S106, and S107 is collectively indicated as step S310.

In step S301, the display control unit 106 refers to the display setting of a low-brightness region. If the setting is enabled (S301: Yes), the display control unit 106 advances to step S302. If the setting is disabled (S301: No), the display control unit 106 advances to step S108.

In step S302, the display control unit 106 detects a low-brightness region having a brightness value not higher than the brightness threshold value of a low-brightness region based on the brightness distribution information inputted from the brightness information acquisition unit 102. A specific detection method is similar to the processing of step S104 of the foregoing embodiment. For example, if the brightness threshold value of a low-brightness region is set at 1 cd/m$^2$, an object 206 (brightness value: 0.1 cd/m$^2$) and an object 207 (brightness value: 0.5 cd/m$^2$) in the image 200 of FIG. 2 are low-brightness regions detected by the display control unit 106.

Subsequently, in step S303, the display control unit 106 refers to the size threshold value of a low-brightness region. From among the low-brightness regions detected in step S302, the display control unit 106 excludes the region smaller than the size threshold value. For example, if the size threshold value of a low-brightness region is set at 100, the object 206 and the object 207 in the image 200 are both 120 in size. Thus, the objects are not excluded from the low-brightness region by the processing of step S303.

A small-sized low-brightness region is assumed to be less important than a large-sized low-brightness region in confirming the brightness of the region. Thus, the present embodiment excludes a low-brightness region smaller than the size threshold value from the display of brightness values, thereby preventing the number of displayed brightness values from excessively increasing in the image.

Subsequently, in step S304, the display control unit 106 determines whether at least one low-brightness region is detected or not. If at least one low-brightness region is detected (S304: Yes), the display control unit 106 advances to step S305. If no low-brightness region is detected (S304: No), the display control unit 106 advances to step S108. In the image 200, the regions of the objects 206 and 207 are detected as low-brightness regions, so that the number of detected high-brightness regions is two. Thus, the display control unit 106 advances from step S304 to step S305.

In step S305, the display control unit 106 calculates a minimum brightness value and the coordinates of a pixel having the minimum brightness value from among pixels included in the low-brightness region in the image. Specifically, the display control unit 106 searches the brightness distribution inputted from the brightness information acquisition unit 102, calculates the brightness value of lowest brightness in the low-brightness region as a minimum brightness value, and calculates the coordinates of a pixel having the minimum brightness value. In the presence of multiple pixels having the minimum brightness value in the image, any one of the pixels may be determined as a pixel having the minimum brightness value. From among pixels having the minimum brightness value in the low-brightness region, one of the pixels may be designated at a position that can be specified by a predetermined direction. For example, the pixel having coordinates at the top left of the image may be designated as a pixel having the minimum brightness value. Alternatively, from among pixels having the minimum brightness value in the low-brightness region, a pixel closest to the barycenter may be designated as a pixel having the maximum brightness value. From among pixels having the minimum brightness value in the low-brightness region, a pixel close to the center (barycenter) in the low-brightness region may be designated as a pixel having the minimum brightness value. In the example of the brightness distribution in FIG. 3, the object 206 has a minimum brightness value of 0.1 cd/m$^2$ and coordinates (1500,1000), which are calculated by the display control unit 106.

Figure 13:
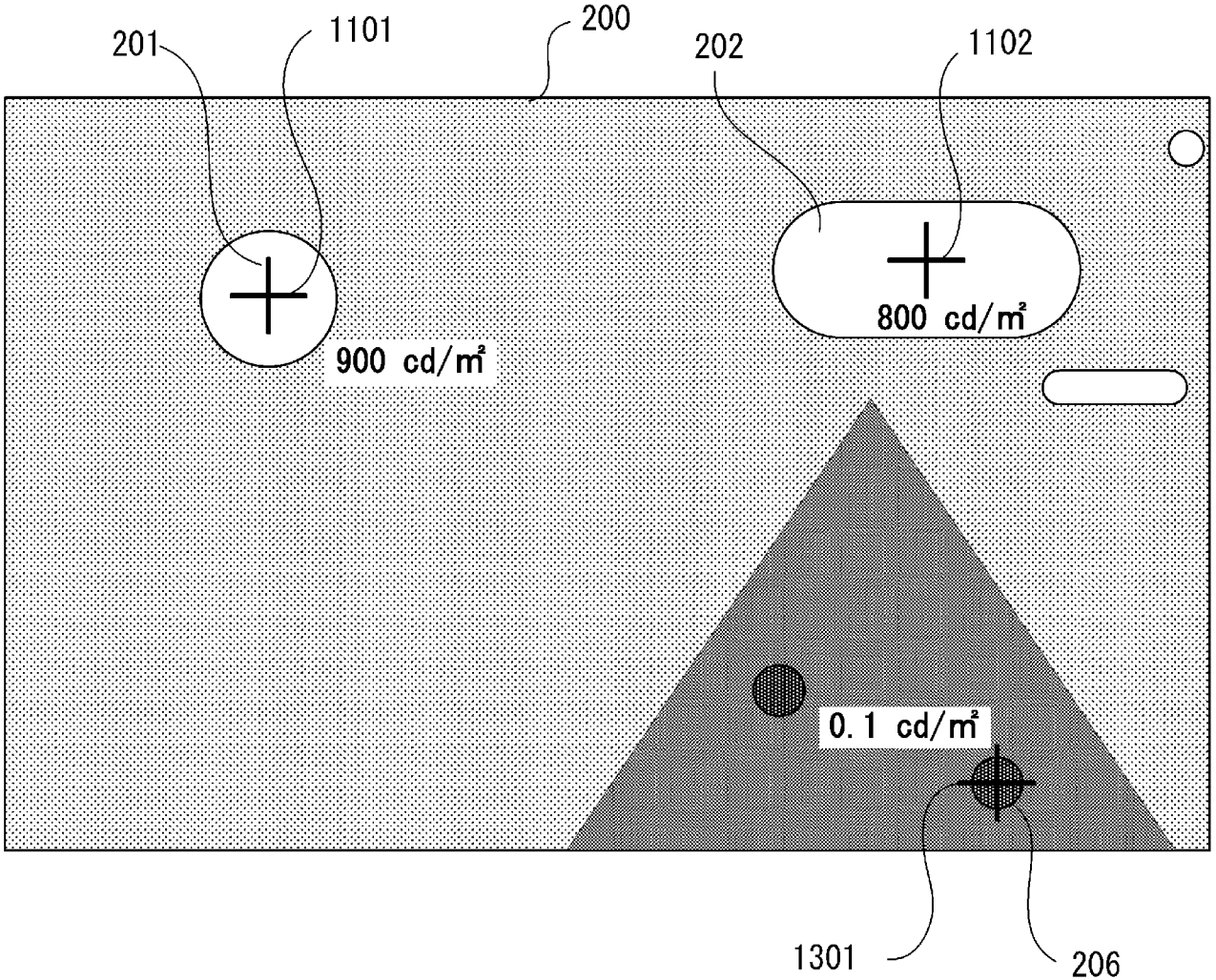
FIG. 13 illustrates a display example of brightness values according to the third embodiment.

Through this processing, the display unit 105 displays the image 200, the maximum brightness value of the high-brightness region as in the second embodiment, and the brightness value of a pixel having a minimum brightness value in a low-brightness region larger than a certain size. FIG. 13 illustrates a display example of the image 200 displayed by the display unit 105 and cursors and brightness values that are superimposed on the image. As illustrated in FIG. 13, cursors 1101, 1102, and 1301 and pixel values are displayed on the objects 201, 202 and 206 of the image 200.

As described above, in the present embodiment, a brightness value is displayed at a pixel having a minimum brightness value in a low-brightness region larger than a certain size in the image in addition to the high-brightness region based on the brightness distribution of the image. This allows a user to confirm the brightness and position of a low-brightness region in the image and compare the high-brightness region and the low-brightness region, thereby confirming the effective use of the wide dynamic range of HDR. Furthermore, a small-sized low-brightness region is excluded from the display of brightness values. This raises expectations on the effect of preventing the number of displayed brightness values from excessively increasing in the image and reducing the viewability of the image.

Fourth Embodiment

A display controller according to a fourth embodiment will be described below. In the present embodiment, a maximum brightness value, a minimum brightness value, and a mean brightness value in a face region recognized in an image are displayed in addition to the display of brightness values in the high-brightness region and the low-brightness region. A face region is an example of a region of a predetermined object. The predetermined object may be an object other than a face or the region of the predetermined object may be a specific region other than the face region. In the following description, the same configurations as those of the first to third embodiments are indicated by the same reference numerals, and a detailed explanation thereof is omitted.

Figure 14:
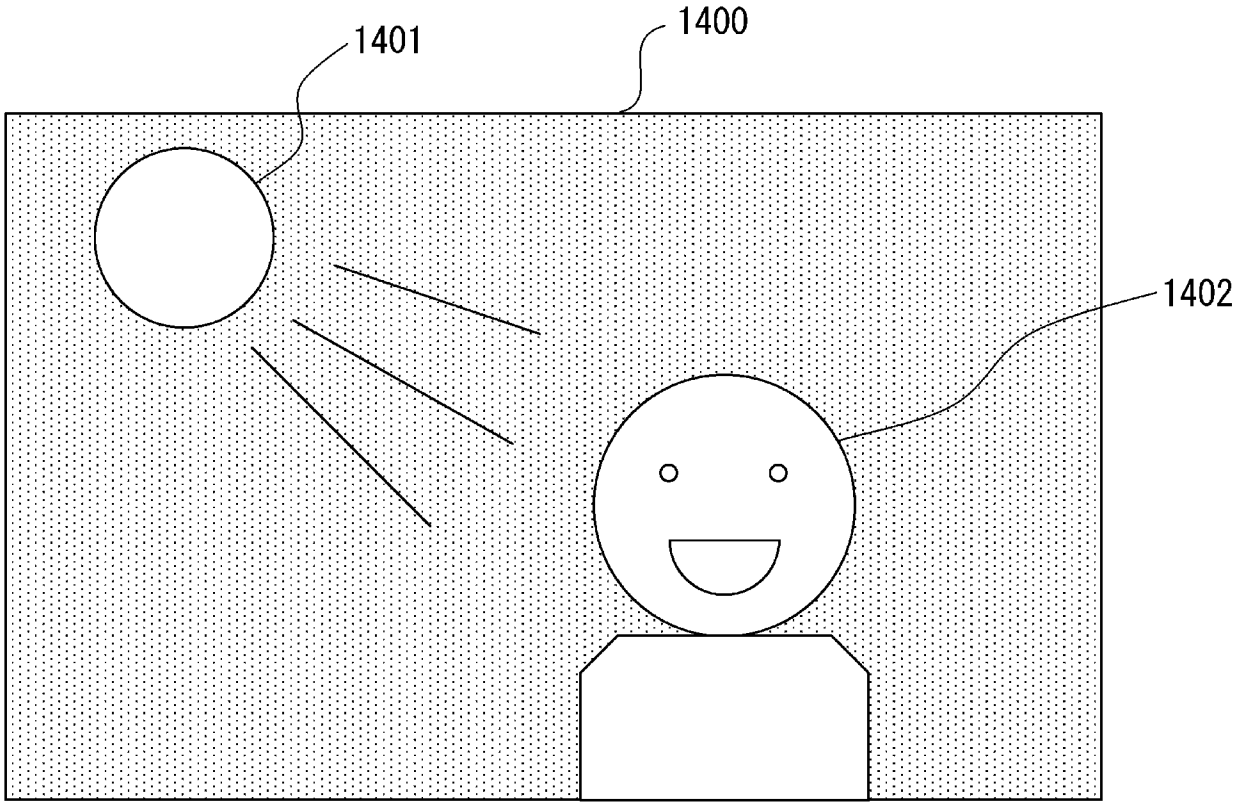
FIG. 14 illustrates an example of an image according to a fourth embodiment.

An image 1400 illustrated as an example in FIG. 14 contains a human face 1402 and a lighting device 1401. For example, the image 1400 has a resolution of 1920 by 1080. In the image 1400, the face 1402 is illuminated with the lighting device 1401. The region of the face 1402 includes a high-brightness part and a low-brightness part.

In addition to the foregoing processing, a brightness information acquisition unit 102 in a display controller 100 of the present embodiment outputs distribution information on the RGB values of pixels in an image as RGB-value distribution information to a display control unit 106. Based on the RGB-value distribution information inputted from the brightness information acquisition unit 102, the display control unit 106 generates face detection information on a face detected from the image by using a face detection model obtained by machine learning.

Moreover, the display control unit 106 has set values for the display setting of the face region and the size threshold value of the face region in addition to the set value of the second embodiment. The display setting of the face region is a setting indicating whether the function of displaying a cursor and a brightness value in the face region detected in the image is enabled or not. The size threshold value of the face region is a threshold value for determining whether the face region in the image is larger than a certain size or not.

Figure 15:
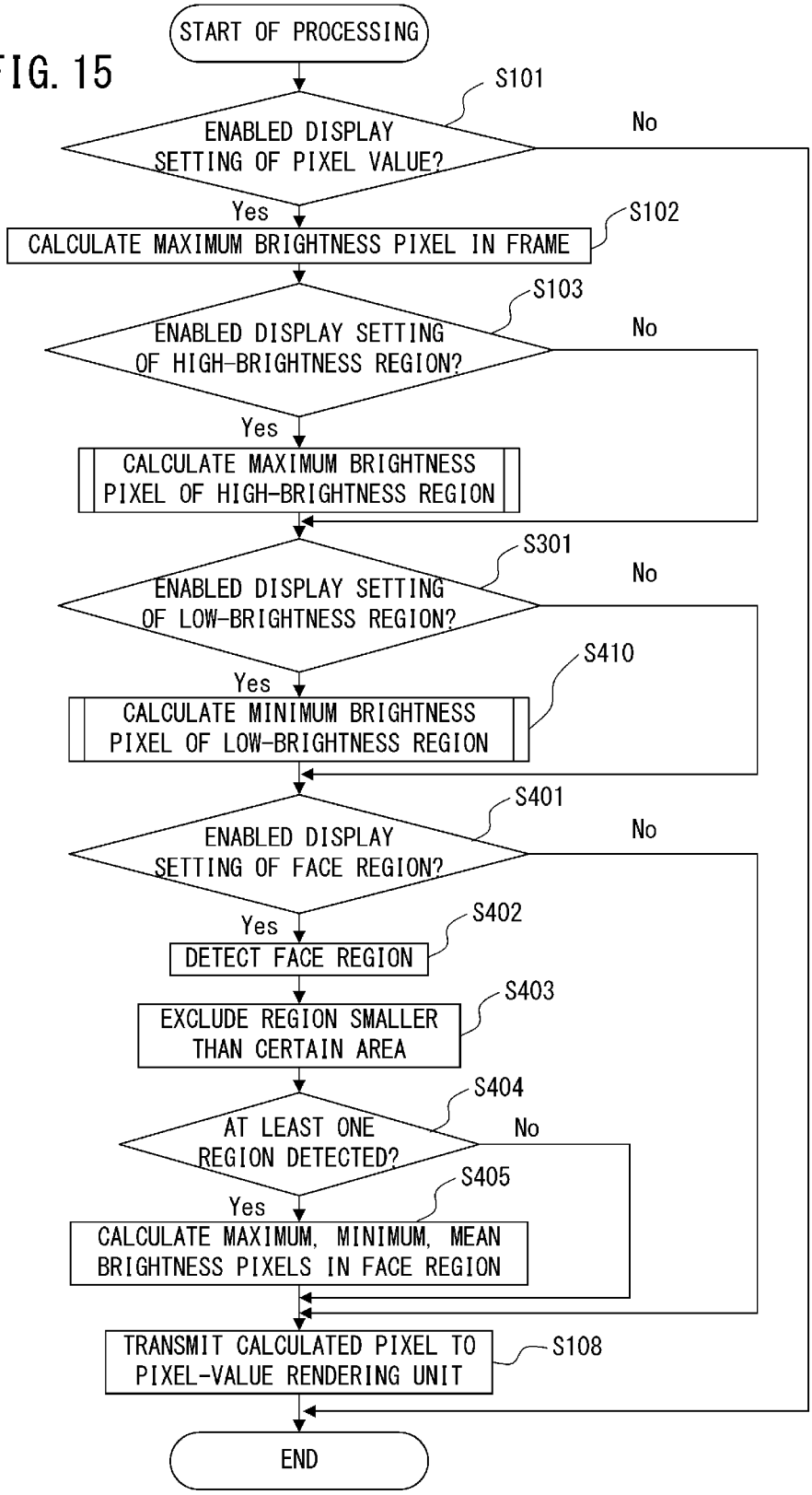
FIG. 15 is a flowchart of processing performed by a display controller according to the fourth embodiment.

In the present embodiment, the coordinates of a pixel having a brightness value are generated by the display control unit 106 according to the flowchart of FIG. 15 instead of the flowchart of FIG. 12 of the third embodiment. When receiving brightness distribution information on frames from the brightness information acquisition unit 102, the display control unit 106 starts the processing of the flowchart of FIG. 15.

The processing performed by the display control unit 106 according to the flowchart of FIG. 15 is different from that of the flowchart of FIG. 12 in the addition of the processing of step S401 to step S405 between step S305 and step S108. In the flowchart of FIG. 15, the processing of steps S302, S303, S304, and S305 is collectively indicated as step S410.

In step S401, the display control unit 106 refers to the display setting of a face region. If the setting of the face region is enabled (S401: Yes), the display control unit 106 advances to step S402. If the display setting is disabled (S401: No), the display control unit 106 advances to step S108.

In step S402, the display control unit 106 detects a face region from the image by using the face detection model based on the RGB distribution information inputted from the brightness information acquisition unit 102. In the detection of the face region, the display control unit 106 first classifies pixels like a face as "face pixels" and pixels like a background as "background pixels" based on the RGB distribution information. For example, the display control unit 106 classifies pixels as "face pixels" and "background pixels" based on numeric values expressing "face-like" and "background-like" by using a face detection model, e.g., Convolutional Neural Network (CNN). When the numeric value of "face-like" is larger than that of "background-like", the display control unit 106 classifies the pixel of the numeric value as "face pixel". As in step S104, the display control unit 106 specifies adjacent "face pixels" so as to detect a face region.

In step S403, the display control unit 106 refers to the size threshold value of a face region. From among face regions detected in step S402, the display control unit 106 excludes the region smaller than the size threshold value from the face region. If the face region detected in the image has a large area, the need for confirming the brightness of the face region increases. Thus, a small face region in the image is excluded from the display of brightness values, thereby suppressing the display of brightness values in a face region where the confirmation of brightness is hardly required.

Subsequently, in step S404, the display control unit 106 determines whether at least one face region is detected or not. If at least one face region is detected (S404: Yes), the display control unit 106 advances to step S405. If no face region is detected (S404: No), the display control unit 106 advances to step S108.

In step S405, the display control unit 106 calculates a maximum brightness value, a minimum brightness value, a mean brightness value, and the coordinates of pixels having the respective brightness values in each face region in the image. The maximum brightness value, the minimum brightness value, and the mean brightness value are examples of a representative brightness value of a face region. Specifically, for each face region, the display control unit 106 searches the brightness distribution inputted from the brightness information acquisition unit 102 and calculates the brightness value of highest brightness as a maximum brightness value, the brightness value of lowest brightness as a minimum brightness value, and a brightness value closest to mean brightness in the face region as a mean brightness value. Moreover, the display control unit 106 calculates the coordinates of pixels having the maximum brightness value, the minimum brightness value, and the mean brightness value. If a face region includes two or more of the brightness values, a pixel having a brightness value to be calculated may be designated at a position that can be specified by a predetermined direction. For example, a pixel having coordinates at the top left of the image may be designated. Alternatively, from among pixels having the brightness values in the face region, a pixel closest to the barycenter may be designated as a pixel having a brightness value to be calculated. From among pixels having the brightness values in the face region, a pixel close to the center (barycenter) in the face region may be designated as a pixel having a brightness value to be calculated.

Figure 16:
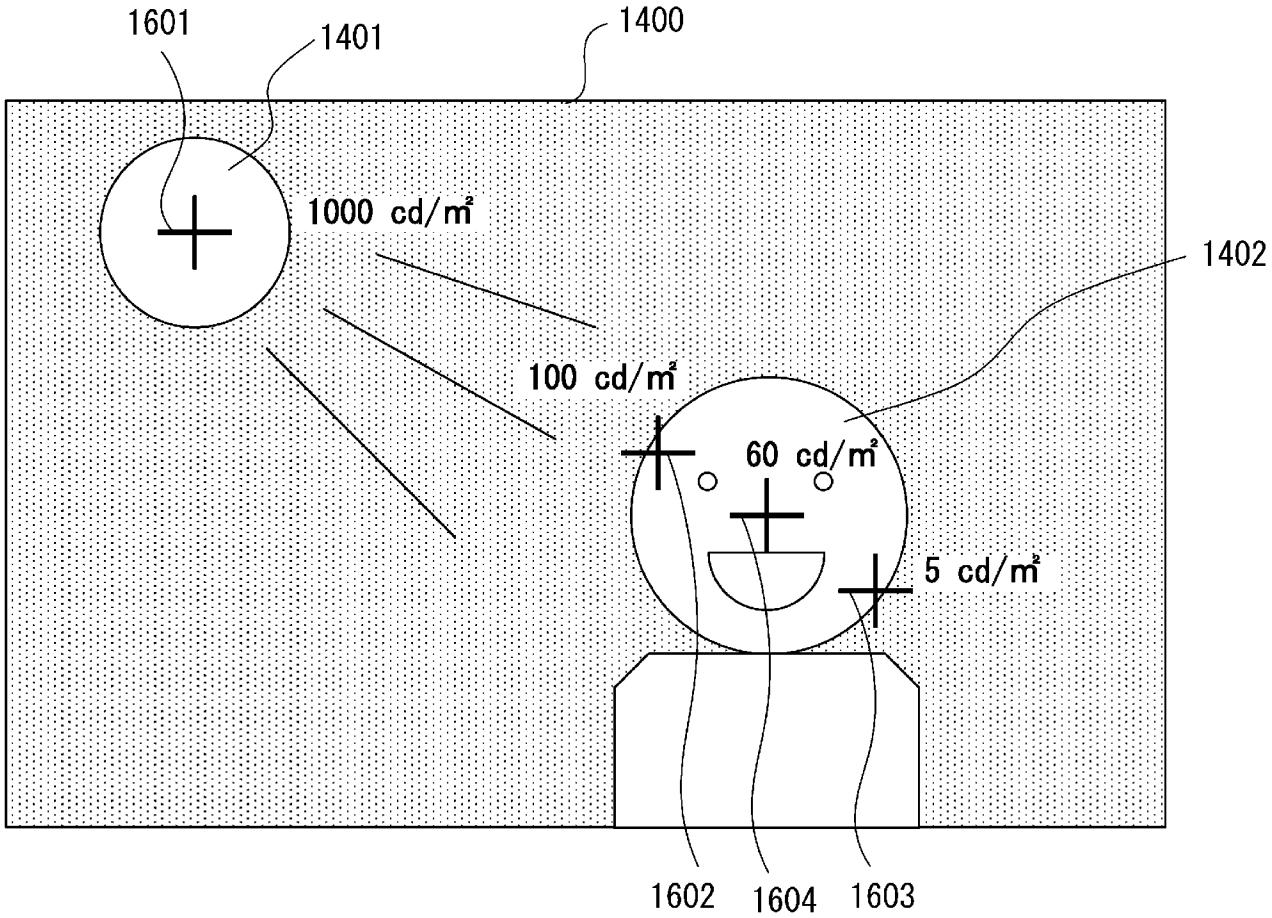
FIG. 16 illustrates a display example of brightness values according to the fourth embodiment.

Through this processing, a display unit 105 displays the image 1400 and the maximum brightness value of the high-brightness region as in the second embodiment. Furthermore, the display unit 105 displays brightness values at pixels having the maximum brightness value, the minimum brightness value, and the mean brightness value of a face region larger than a certain size. FIG. 16 illustrates a display example of the image 1400 displayed by the display unit 105 and cursors and brightness values that are superimposed on the image. As illustrated in FIG. 16, a cursor 1601 indicating the position of a pixel having a maximum brightness value and the brightness value ("1000 cd/$m^2$" in FIG. 16) are displayed in the region of the lighting device 1401 in the image 1400. Moreover, cursors 1602, 1603, and 1604 indicating the positions of pixels having the maximum brightness value, the minimum brightness value, and the mean brightness value and the brightness values ("100 cd/$m^2$", "5 cd/$m^2$", "60 cd/$m^2$" in FIG. 16) are displayed in the region of the detected face 1402.

As described above, in the present embodiment, brightness values are displayed at pixels having a maximum brightness value, a minimum brightness value, and a mean brightness value in the region of a detected face in an image based on the brightness distribution of the image. Thus, by confirming, for example, the mean brightness value in the face region, a user can determine whether the brightness of the face region in the image is set within a skin brightness range defined by the foregoing BT.2408. Moreover, by confirming, for example, the maximum brightness value or the minimum brightness value, the user can determine whether the face region of the image partially has extremely high or low brightness.

OTHER EMBODIMENTS

The foregoing embodiments merely illustrate specific examples of the disclosure. The scope of the disclosure is not limited to the configurations of the foregoing embodiments. Various embodiments may be used without changing the scope of the disclosure.

For example, in the above description, the display controller performs a series of processing for displaying brightness values in an image. The processing performed by the display controller may be partially performed by other devices. For example, the calculation of a brightness value, the generation of a cursor indicating the position of a pixel, and the superimposition on an image may be performed by a PC separated from the display controller, and then a display image outputted from the PC may be displayed by the display controller. In the above description, when it is determined whether a size, brightness, or a change in brightness is larger than the threshold value or not, the size, the brightness, or the change in brightness may be equal to the threshold value. In this case, the same processing may be performed as processing when the threshold value is smaller or processing when the threshold value is larger.

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

The disclosure can save time for manually changing the display position of brightness and the number of displayed brightness values in an image.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-078472, filed on Apr. 27, 2020, which is hereby incorporated by reference herein in its entirety.

What is claimed is:

1. A display controller comprising:

a processor; and a memory storing a program, the program being executed to cause the processor to perform operations comprising:

detecting, based on a brightness distribution of an input image, a region satisfying predetermined conditions from the input image, and displaying a display image based on the input image and controlling a value of representative brightness of the detected region such that the value is displayed in association with the detected region in the displayed image, wherein the brightness distribution includes brightness values of pixels and positions of the pixels.

2. The display controller according to claim 1, wherein detecting detects a region having a pixel brightness higher than first predetermined brightness.

3. The display controller according to claim 1, wherein detecting detects a region having a pixel brightness lower than second predetermined brightness.

4. The display controller according to claim 1, wherein the predetermined conditions include a region size larger than a predetermined size.

5. The display controller according to claim 4, wherein the size is the number of pixels.

6. The display controller according to claim 1, wherein the predetermined conditions include a degree of change in brightness between a region and a region surrounding the region, the degree of change being greater than a predetermined degree.

7. The display controller according to claim 1, wherein detecting detects a region of a predetermined object.

8. The display controller according to claim 7, wherein the predetermined object is a face.

9. The display controller according to claim 1, wherein the representative brightness includes at least any of maximum brightness, minimum brightness, and mean brightness of the detected region.

10. The display controller according to claim 1, wherein controlling controls the value of the representative brightness so as to display the value in association with a pixel corresponding to the representative brightness in the detected region.

11. The display controller according to claim 1, wherein the display image includes an indicator located at a representative position, in the positions of the pixels, that corresponds to the pixel having the value of the representative brightness of the region.

12. The display controller according to claim 11, wherein the indicator is a cursor.

13. A display control method comprising:

detecting, based on a brightness distribution of an input image, a region satisfying predetermined conditions from the input image; and displaying a display image based on the input image and controlling a value of representative brightness of the detected region such that the value is displayed in association with the detected region in the displayed image, wherein the brightness distribution includes brightness values of pixels and positions of the pixels.

14. The display control method according to claim 13, wherein the display image includes an indicator located at a representative position, in the positions of the pixels, that corresponds to the pixel having the value of the representative brightness of the region.

15. The display control method according to claim 14, wherein the indicator is a cursor.

16. A non-transitory computer-readable storage medium storing a program for causing a computer to perform operations comprising:

detecting, based on a brightness distribution of an input image, a region satisfying predetermined conditions from the input image; and displaying a display image based on the input image and controlling a value of representative brightness of the detected region such that the value is displayed in association with the detected region in the displayed image, wherein the brightness distribution includes brightness values of pixels and positions of the pixels.

* * * * *